US010741964B2

(12) United States Patent
Matsui et al.

(10) Patent No.: US 10,741,964 B2
(45) Date of Patent: Aug. 11, 2020

(54) JOINT CONNECTOR WITH SHORT CIRCUIT MEMBERS SHORTING SELECTED TABS

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/475,481

(22) PCT Filed: Dec. 18, 2017

(86) PCT No.: PCT/JP2017/045259
§ 371 (c)(1),
(2) Date: Jul. 2, 2019

(87) PCT Pub. No.: WO2018/128070
PCT Pub. Date: Jul. 12, 2018

(65) Prior Publication Data

US 2019/0341716 A1 Nov. 7, 2019

(30) Foreign Application Priority Data

Jan. 6, 2017 (JP) ..... 2017-001078

(51) Int. Cl.
*H01R 31/08* (2006.01)
*H01R 13/514* (2006.01)
(Continued)

(52) U.S. Cl.
CPC ..... *H01R 13/514* (2013.01); *H01R 13/422* (2013.01); *H01R 13/428* (2013.01);
(Continued)

(58) Field of Classification Search
CPC .... H01R 31/08; H01R 13/7032; H01R 29/00; H01R 13/703; H01R 12/724; H01R 31/085; H01R 13/7031; H01R 13/7034
(Continued)

(56) References Cited

U.S. PATENT DOCUMENTS 3,208,028 A * 9/1965 Mittler ..... H01R 12/523 439/45
3,701,964 A * 10/1972 Cronin ..... H01R 12/774 439/45
(Continued)

FOREIGN PATENT DOCUMENTS

JP 05-114315 5/1993
JP 2003-059598 2/2003
(Continued)

OTHER PUBLICATIONS

International Search Report dated Jan. 16, 2018.

*Primary Examiner* — Abdullah A Riyami
*Assistant Examiner* — Justin M Kratt
(74) *Attorney, Agent, or Firm* — Gerald E. Hespos; Michael J. Porco; Matthew T. Hespos

(57) ABSTRACT

It is aimed to simplify the shape of a short-circuit means. A joint connector (A) includes a housing (10), a plurality of terminal fittings (35F, 35S, 35T) provided in the housing (10) and each formed such that a plurality of tabs (37F, 37D, 7R) are coupled by a terminal base portion (36), and a short-circuit module (40) provided in the housing (10) and formed by arranging a plurality of short-circuit plates (42) side by side in a length direction of the tabs (37F, 37D, 37R).
(Continued)

The short-circuit plate (42) is formed with a plurality of conduction holes (45) for allowing the tabs (37F, 37D, 37R) to pass therethrough in a contact state and non-contact holes (44) for allowing the tabs (37F, 37D, 37R) to pass therethrough in a non-contact state, and an arrangement of the plurality of conduction holes (45) differs among the plurality of short-circuit plates (42).

12 Claims, 17 Drawing Sheets

(51) Int. Cl.

| | |
|---|---|
| ***H01R 13/422*** | (2006.01) |
| ***H01R 13/428*** | (2006.01) |
| ***H01R 13/631*** | (2006.01) |
| ***H01R 31/06*** | (2006.01) |
| *H01R 29/00* | (2006.01) |
| *H01R 9/26* | (2006.01) |
| *H01R 13/703* | (2006.01) |
| *H01R 12/72* | (2011.01) |

(52) U.S. Cl.
CPC ..... *H01R 13/631* (2013.01); *H01R 31/06* (2013.01); *H01R 9/2675* (2013.01); *H01R 12/724* (2013.01); *H01R 13/7031* (2013.01); *H01R 13/7032* (2013.01); *H01R 29/00* (2013.01); *H01R 31/08* (2013.01); *H01R 31/085* (2013.01)

(58) Field of Classification Search
USPC ..... 439/507–514, 188, 189, 45, 225
See application file for complete search history.

(56) References Cited

U.S. PATENT DOCUMENTS

| | | | | |
|---|---|---|---|---|
| 4,037,912 | A | 7/1977 | Besser | |
| 4,174,878 | A | 11/1979 | Debaigt | |
| 4,399,371 | A | 8/1983 | Ziff | |
| 4,487,464 | A | 12/1984 | Kirschenbaum | |
| 4,556,274 | A | 12/1985 | Olivera | |
| 5,000,699 | A | 3/1991 | Nadin | |
| 5,007,888 | A | 4/1991 | Goutiere | |
| 5,073,120 | A | 12/1991 | Lincoln | |
| 5,106,318 | A | 4/1992 | Endo | |
| 5,414,587 | A * | 5/1995 | Kiser ..... | H01R 13/6397 361/118 |
| 5,474,475 | A | 12/1995 | Yamaguchi | |
| 5,503,565 | A | 4/1996 | McCoy | |
| 5,645,455 | A | 7/1997 | Seki | |
| 5,908,322 | A | 6/1999 | Seki | |
| 6,739,920 | B2 | 5/2004 | Fujii | |
| 7,867,001 | B2 | 1/2011 | Ambo | |
| 8,817,576 | B2 | 8/2014 | Tsuzuki | |
| 9,112,293 | B2 | 8/2015 | Suzuki | |
| 9,531,104 | B1 | 12/2016 | Park | |
| 9,698,550 | B2 | 7/2017 | Byrne | |
| 2003/0040224 | A1 | 2/2003 | Fujii et al. | |

FOREIGN PATENT DOCUMENTS

| | | |
|---|---|---|
| JP | 2004-311223 | 11/2004 |
| JP | 2005-038737 | 2/2005 |
| JP | 5330925 | 10/2013 |

* cited by examiner

JOINT CONNECTOR WITH SHORT CIRCUIT MEMBERS SHORTING SELECTED TABS

BACKGROUND

Field of the Invention

The present invention relates to a joint connector.

Related Art

Japanese Unexamined Patent Publication No. 2003-59598 discloses a joint connector in which a plurality of joint terminals are provided in a relay housing. A joint terminal is composed of a base and a plurality of tab pieces projecting from different positions on the base. One end part of each tab piece is accommodated in a receptacle-like electrical component-side connector connecting portion, and the other end part thereof is accommodated in a receptacle-like power supply-side connector connecting portion. If connectors of wiring harnesses are fit respectively to the electrical component-side connector connecting portion and the power supply-side connector connecting portion, any one of a plurality of female terminal fittings provided in an electrical component-side connector and any one of a plurality of female terminal fittings provided in a power supply-side connector are connected to be possibly shorted via one joint terminal.

Since the above joint terminal is formed by coupling the plurality of tab pieces by the base, the shape of the bases has to be complicated to avoid the mutual interference of the bases if two pairs of the female terminal fittings desired to be shorted are arranged, for example, on two diagonals intersecting each other.

The present invention was completed on the basis of the above situation and aims to simplify the shape of a short-circuit means.

SUMMARY

The invention is directed to a joint connector with a housing. Terminal fittings are provided in the housing and each is formed such that tabs are coupled by a terminal base, and a short-circuit module provided in the housing and are formed by arranging short-circuit members side by side in a length direction of the tabs. Each short-circuit member is formed with conduction holes for allowing the tabs to pass therethrough in a contact state and a non-contact hole for allowing the tab to pass therethrough in a non-contact state. An arrangement of the conduction holes is different among the of short-circuit members.

Since the respective tabs pass through the short-circuit members and contact the short-circuit members in the conduction holes, the tabs can be conductive with each other via one short-circuit member. If mating terminals are connected to the tabs, the mating terminals connected to the tabs in a conductive state can be shorted to each other. Since the short-circuit members for making the tabs conductive with each other are arranged side by side in the length direction of the tabs, the short-circuit members do not interfere with each other. Thus, the shapes of the short-circuit members can be simplified.

The conduction hole may be formed with a resilient contact piece projecting inward from an edge part of the conduction hole and is capable of resiliently contacting the tab. According to this configuration, since the resilient contact piece is resiliently deformed when the tab passes through the conduction hole, resistance can be small.

The short-circuit members may be laminated via an insulating member. According to this configuration, a short circuit between the short-circuit members can be prevented.

The insulating member may be formed with a guide hole corresponding to the non-contact hole and may have a smaller opening region than the non-contact hole. According to this configuration, the contact of the tab with an edge of the non-contact contact hole can be prevented.

The insulating member and the short-circuit members of certain embodiments can be assembled. According to this configuration, if one short-circuit unit is configured by assembling the insulating member and the short-circuit members, the short-circuit members and the insulating member are handled easily.

The short-circuit members and the insulating member may be formed with erroneous assembly preventing portions fittable only when the short-circuit members and the insulating member are assembled properly. According to this configuration, the short-circuit members and the insulating member cannot be assembled improperly.

DETAILED DESCRIPTION

Figure 1:
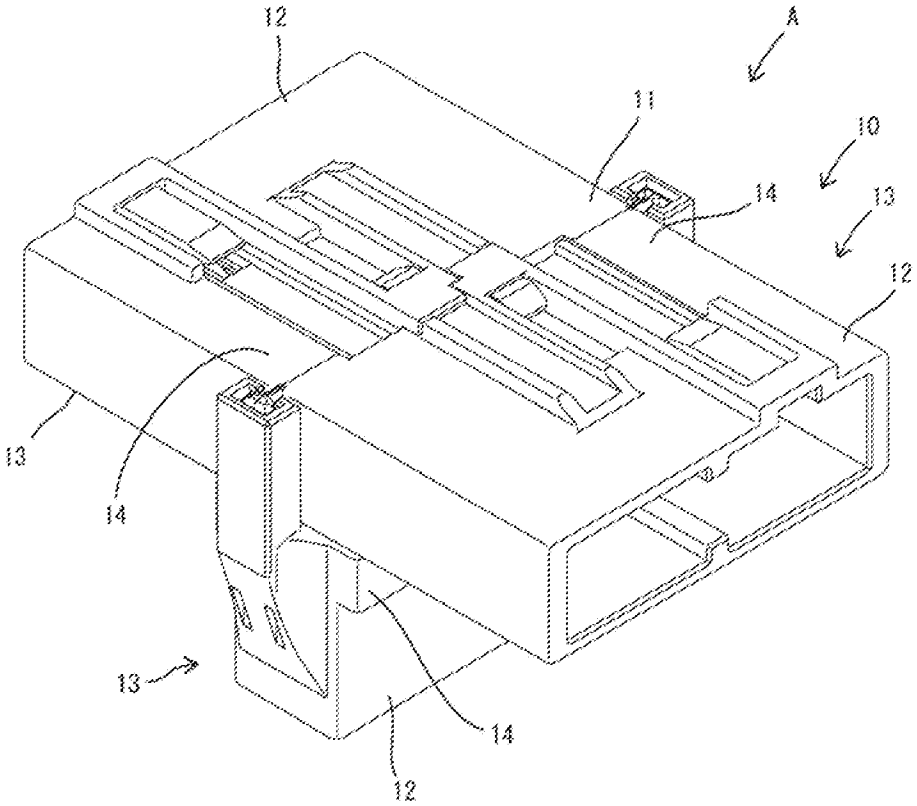
FIG. 1 is a perspective view of a joint connector of one embodiment.
Figure 2:
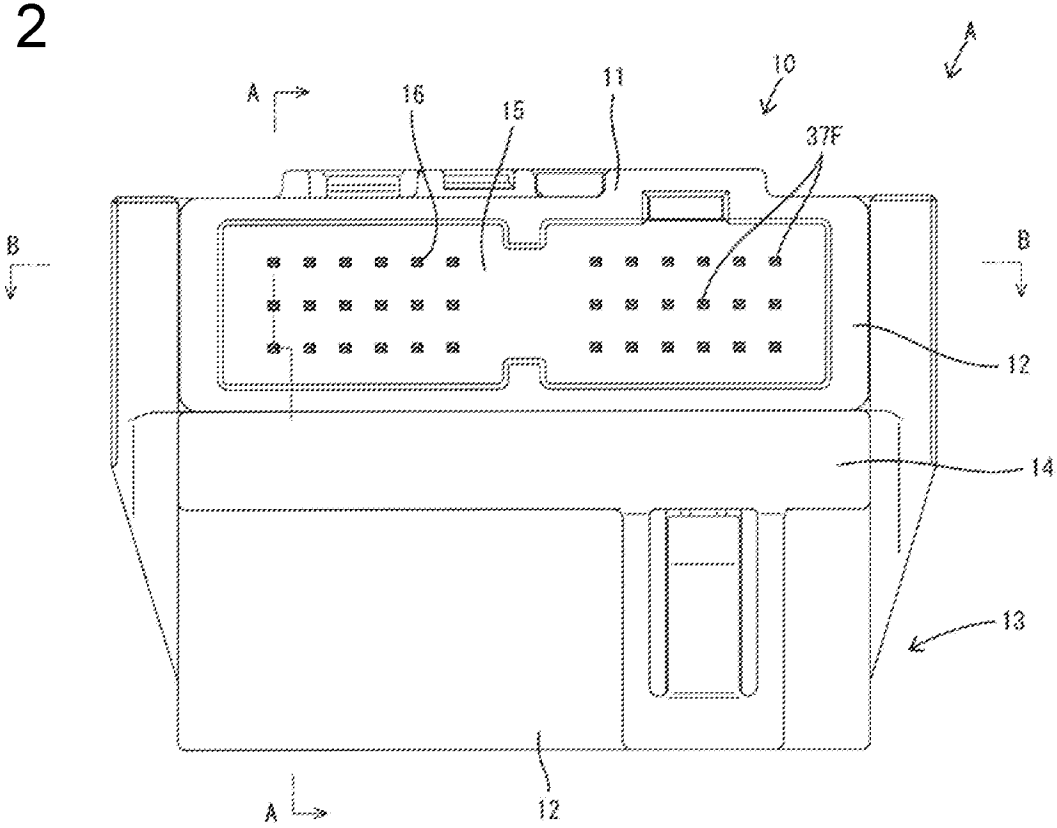
FIG. 2 is a front view of the joint connector.
Figure 3:
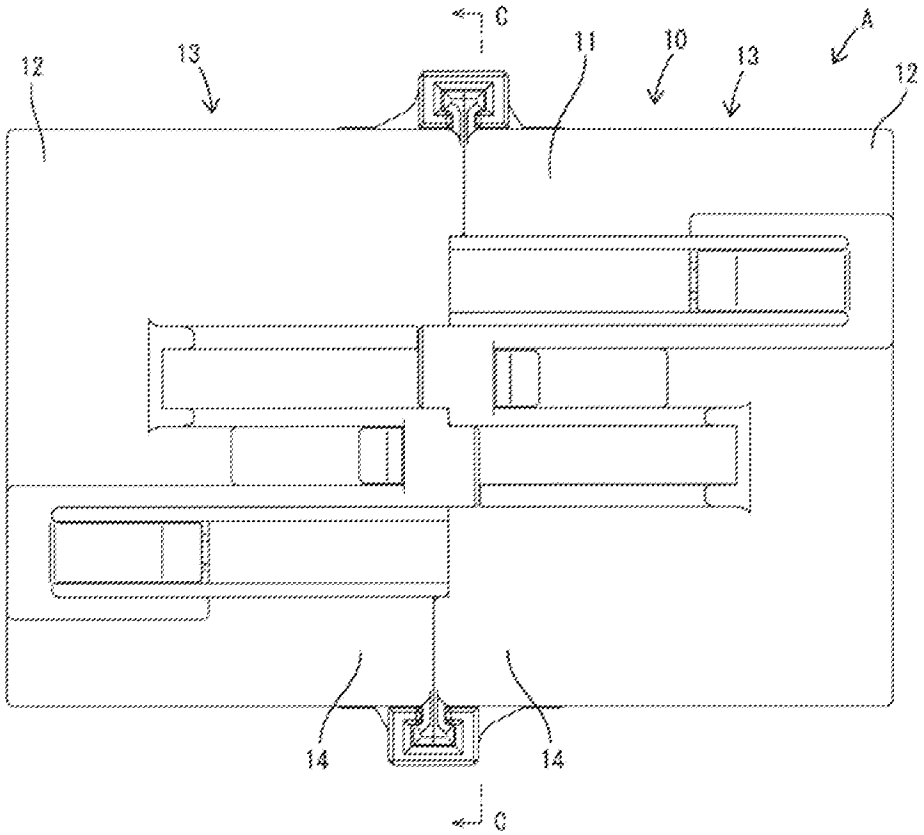
FIG. 3 is a plan view of the joint connector.
Figure 4:
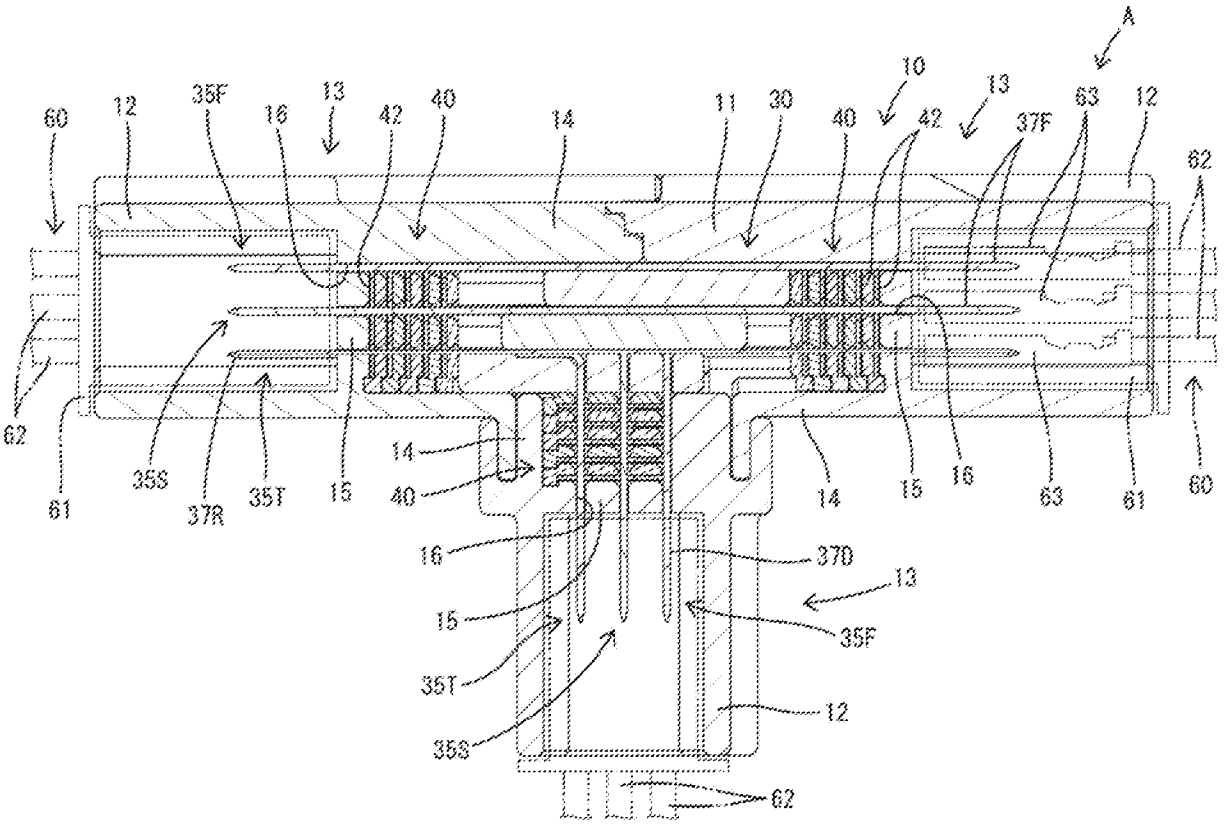
FIG. 4 is a section along A-A of FIG. 2.
Figure 5:
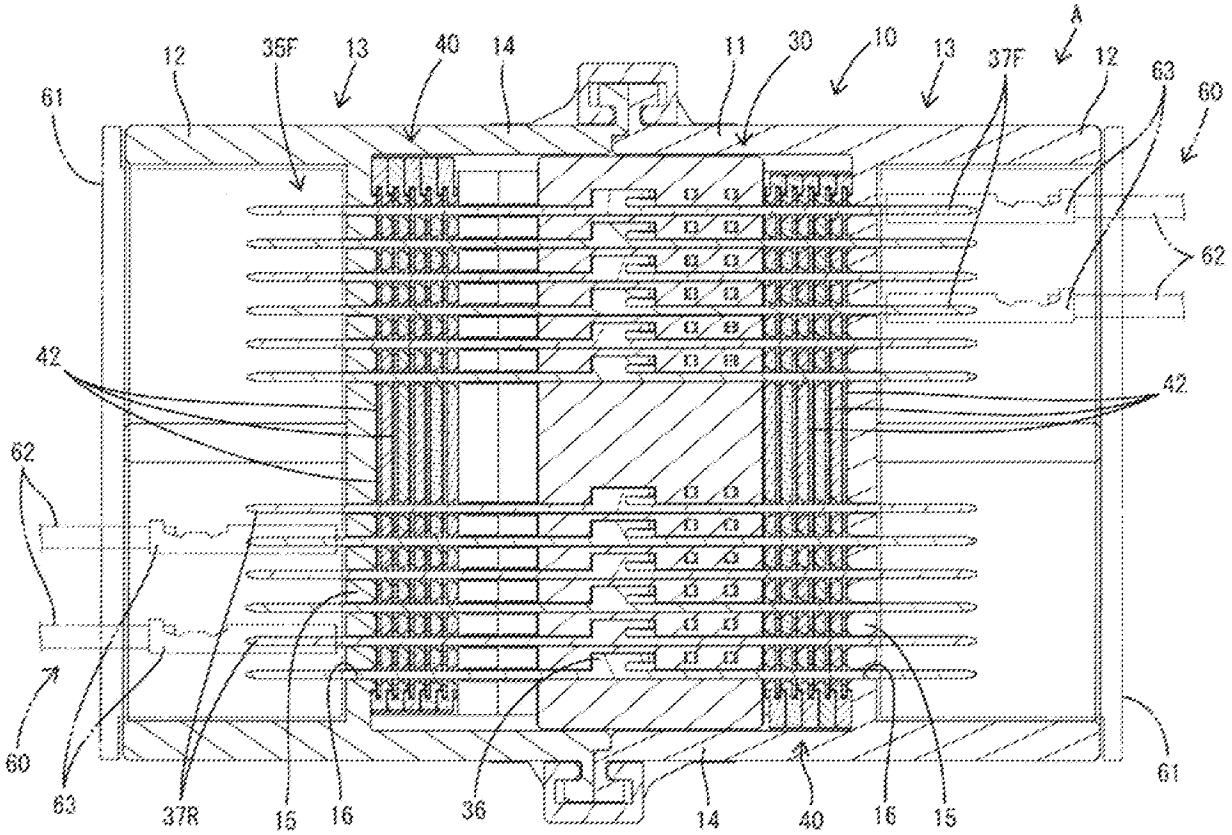
FIG. 5 is a section along B-B of FIG. 2.
Figure 6:
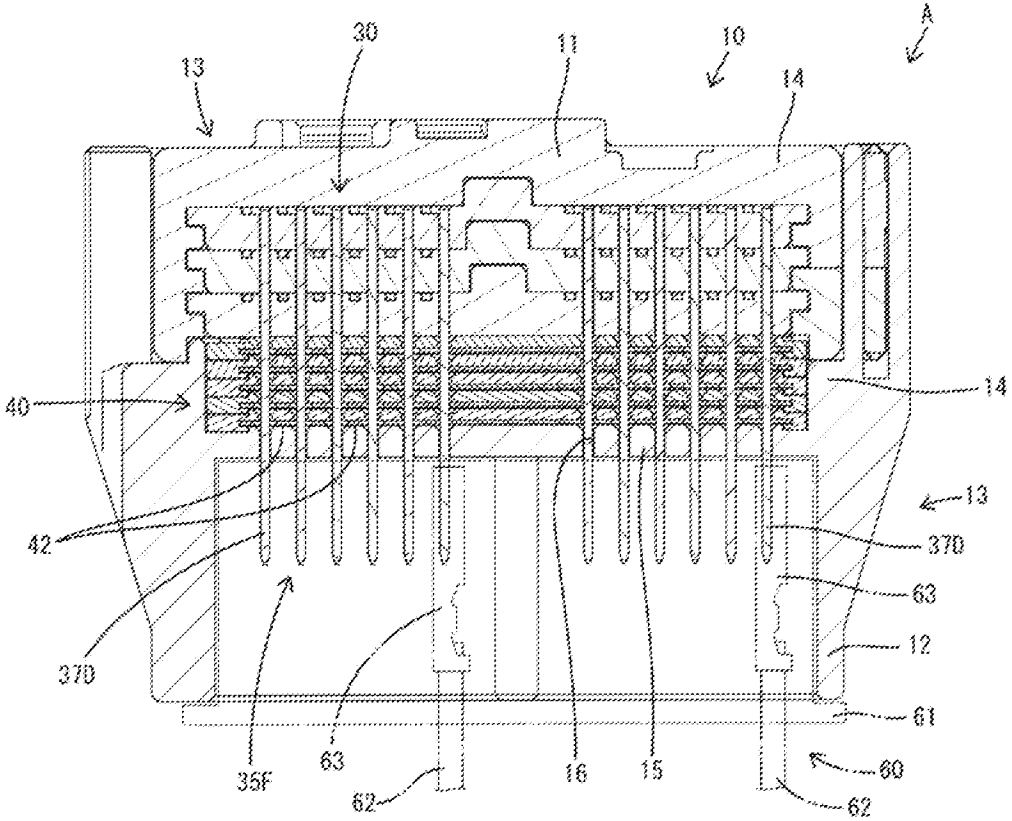
FIG. 6 is a section along C-C of FIG. 3.
Figure 7:
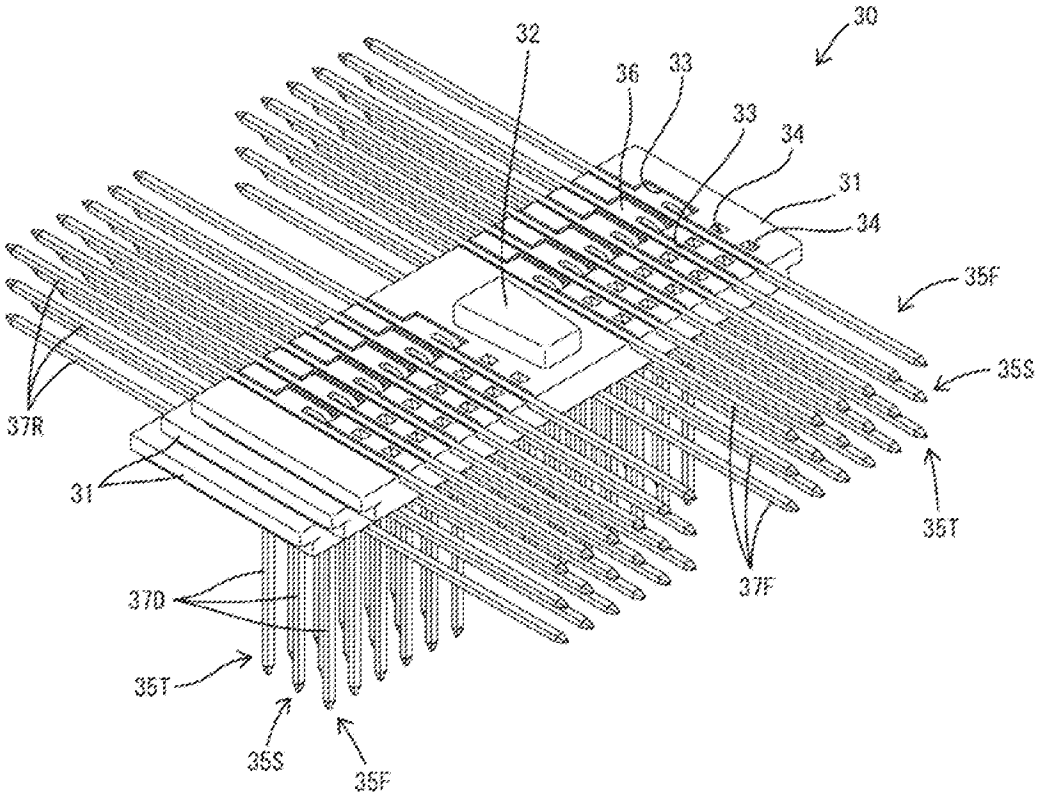
FIG. 7 is a perspective view of a terminal module configured by temporarily holding a plurality of terminal fittings by three temporary holding members.

An embodiment of the invention is described with reference to FIGS. 1 to 17. Note that, in the following description, a right side in FIGS. 3 to 5 is defined as a front concerning a front-rear direction. Upper and lower sides shown in FIGS. 1, 2, 4, 6 to 9 and 11 to 17 are defined as upper and lower sides concerning a vertical direction.

A joint connector A of this embodiment is connected to mating connectors 61 provided on end parts of wiring harnesses 60. Mating terminals 63 individually fixed to wires 62 of the wiring harness 60 are mounted in the mating connector 61. The joint connector A is for enabling selected mating terminals 63 to be shorted to each other. The joint connector A and terminal fittings 35, 35S, 35T to be described later have both a relaying function of relaying the wiring harnesses 60 to each other and a branching function of branching the wiring harnesses 60.

<Overall Configuration of Joint Connector A and Housing 10>

The joint connector A includes a housing 10 made of synthetic resin, one terminal module 30 provided in the housing 10 and three short-circuit modules 40 provided in the housing 10. The housing 10 includes a box-shaped body 11 whose interior serves as an accommodation space and three receptacles 12 in the form of rectangular tubes projecting in mutual different directions (forward, rearward and downward directions) from the body 11. The housing 10 is substantially T-shaped in a side view.

The mating connector 61 is fit into the receptacle 12, and the mating terminals 63 are connected individually to tabs 37F, 37D, 37R to be described later in the receptacle 12. The housing 10 is configured by uniting three divided bodies 13. Each divided body 13 includes an accommodating portion 14 in the form of a rectangular tube constituting the body portion 11 and the receptacle 12, and the accommodating portion 14 and the receptacle 12 are partitioned by a separation wall 15. The separation wall 15 is formed with positioning holes 16 for positioning the tabs 37F, 37D, 37R of the terminal fittings 35, 35S, 35T to be described later by allowing these tabs to pass therethrough.

<Terminal Module 30>

Figure 8:
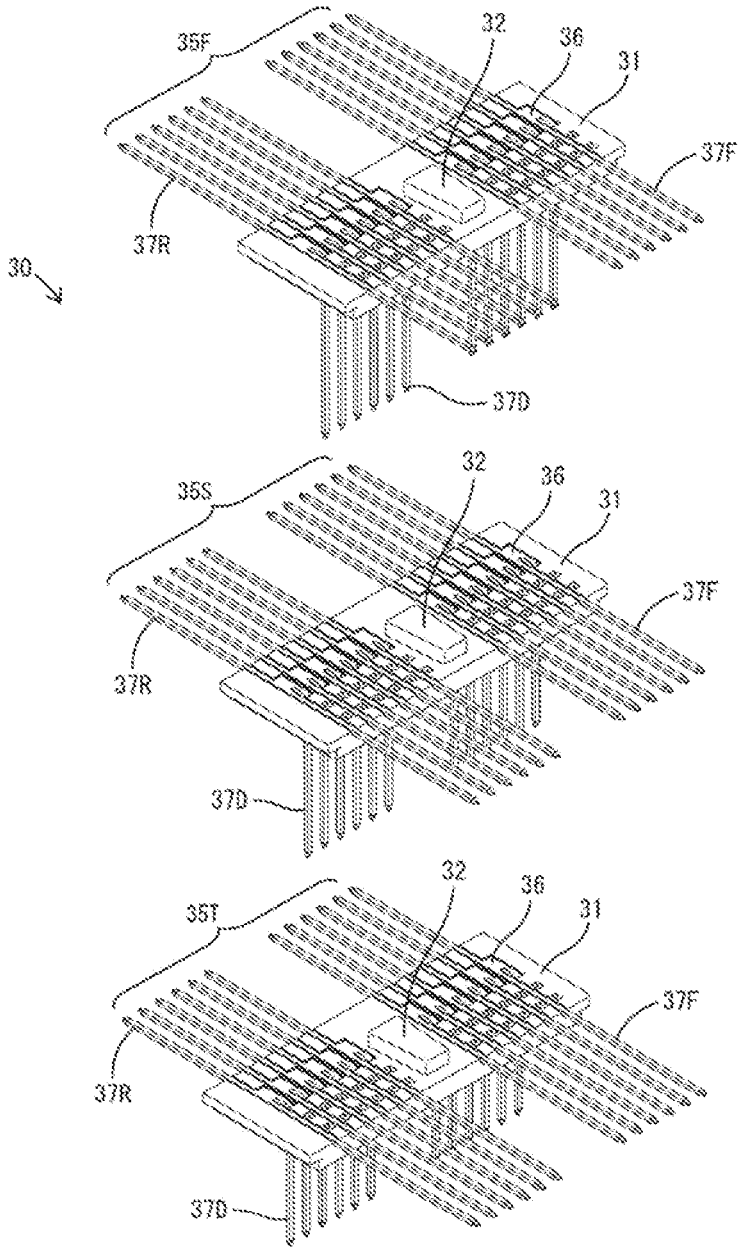
FIG. 8 is a perspective view showing a state where the terminal module is divided into three.

As shown in FIG. 8, the terminal module 30 is composed of three temporary holding members 31, first terminal fittings 35F, second terminal fittings 35S and third terminal fittings 35T. The three temporary holding members 31 have the same shape and dimensions, and are laminated while being displaced in the front-rear direction by assembling fitting projections 32 on upper surfaces and fitting recesses (not shown) in lower surfaces. Holding grooves 33 elongated in the front-rear direction are formed laterally in parallel in the upper surface of the temporary holding member 31. The temporary holding member 31 is formed with through holes 34 vertically penetrating through the temporary holding member 31.

Each terminal fitting 35, 35S, 35T is a single component processed by bending a metal plate material and composed of a terminal base 36, a forward facing tab 37F (tab as claimed) extending straight forward from the front end edge of the terminal base 36, a rearward facing tab 37R extending straight rearward from the rear end edge of the terminal base 36 and a downward facing tab 37D extending straight down from the terminal base 36.

The terminal base 36, the forward facing tab 37F and the rearward facing tab 37R are connected linearly in the front-rear direction. The downward facing tab 37D extends at a right angle to both front and rear tabs 37F, 37R from a position of the front end of the terminal base 36 laterally deviated from a base end of the forward facing tab 37F (rear end part connected to the terminal base 36). Each tab 37F, 37D and 37R has a substantially square or rectangular cross-sectional shape.

As shown in FIG. 8, the first terminal fittings 35F are held temporarily in the uppermost temporary holding member 31, the second terminal fittings 35S are held temporarily in the middle temporary holding member 31 and the third terminal fittings 35T are held temporarily in the lowermost temporary holding member 31. In the temporarily held state, the downward facing tabs 37D are inserted through the through holes 34 and the terminal base portions 36 and base end parts (rear end parts) of the forward facing tabs 37F and base end parts (front end parts) of the rearward facing tabs 37R are fit into the holding grooves 33, thereby being positioned in the front-rear direction and the lateral direction. The forward facing tabs 37F are aligned in the vertical direction and the lateral direction, the rearward facing tabs 37R also are aligned in the vertical direction and the lateral direction and the downward facing tabs 37D are aligned in the front-rear direction and the lateral direction.

<Short-Circuit Module 40>

Figure 9:
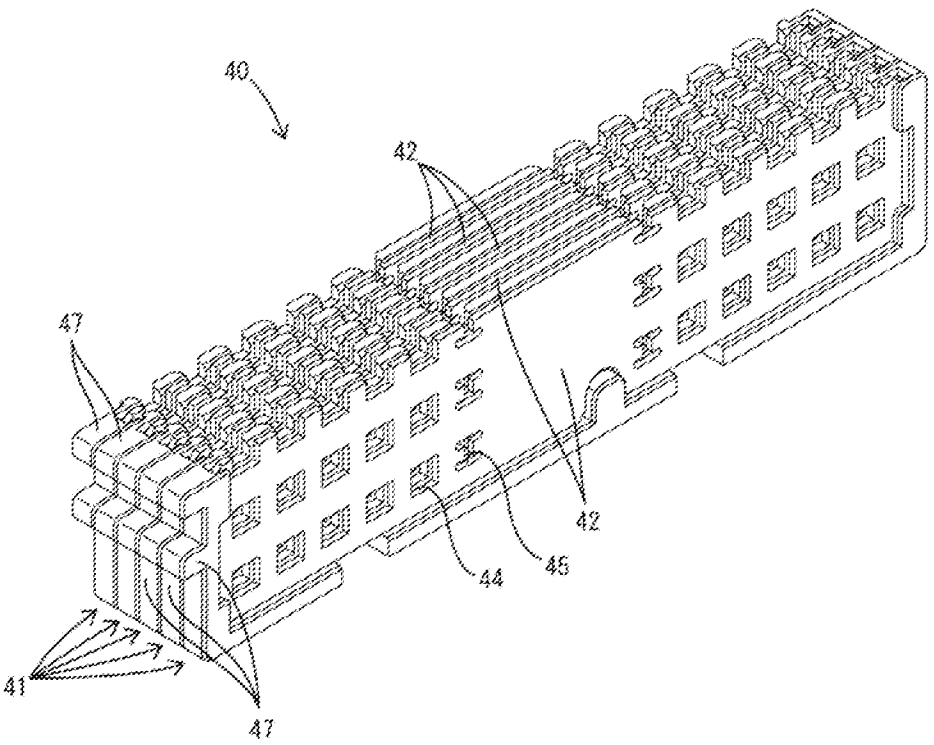
FIG. 9 is a perspective view of a short-circuit module.
Figure 10:
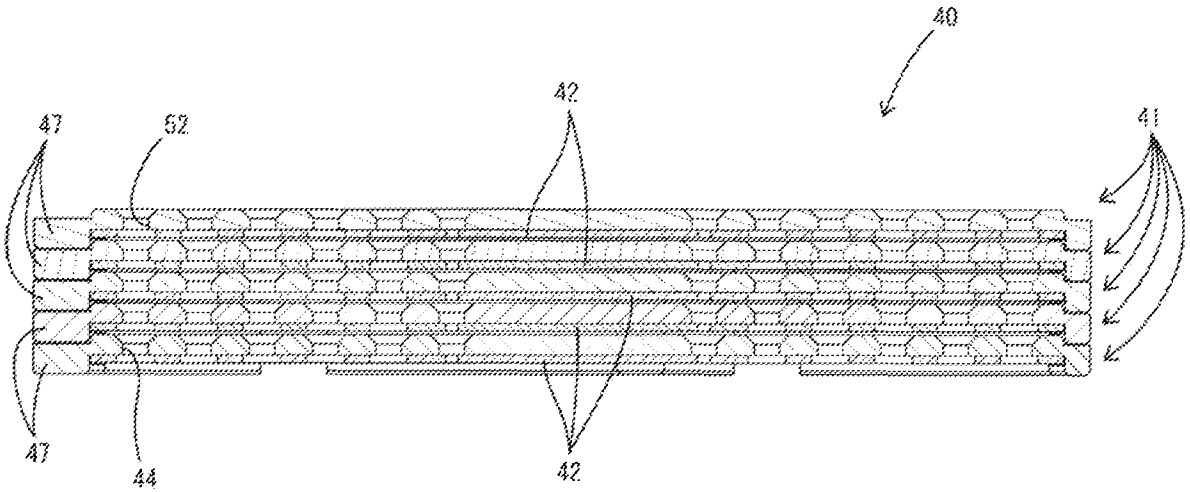
FIG. 10 is a plan view in section of the short-circuit module.
Figure 11:
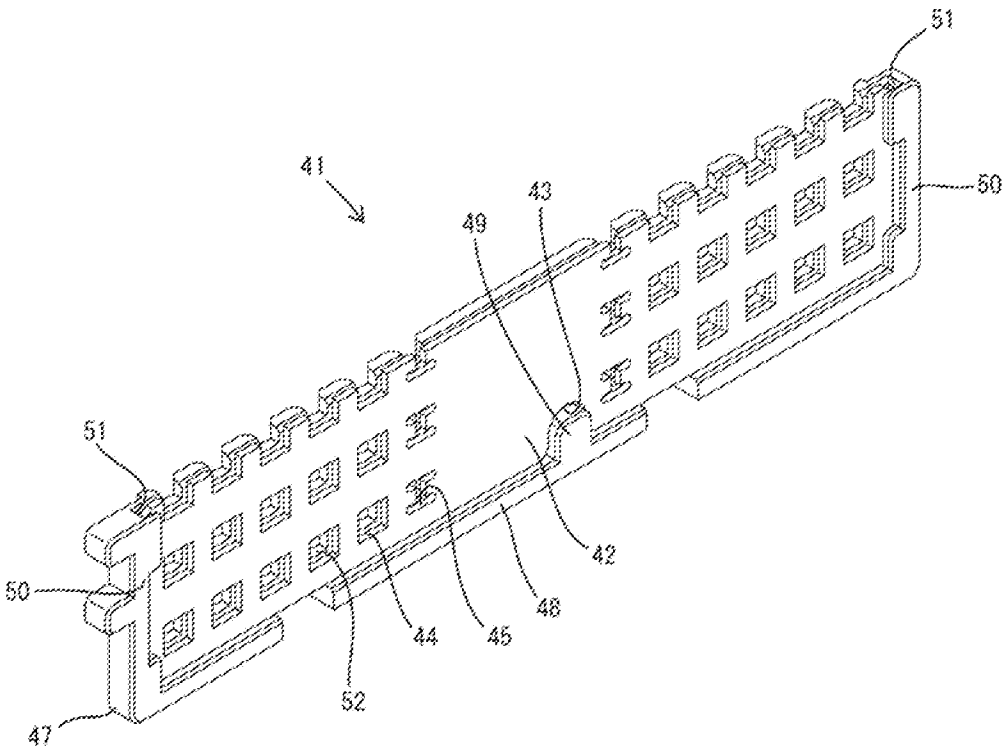
FIG. 11 is a perspective view of a short-circuit unit.
Figure 12:
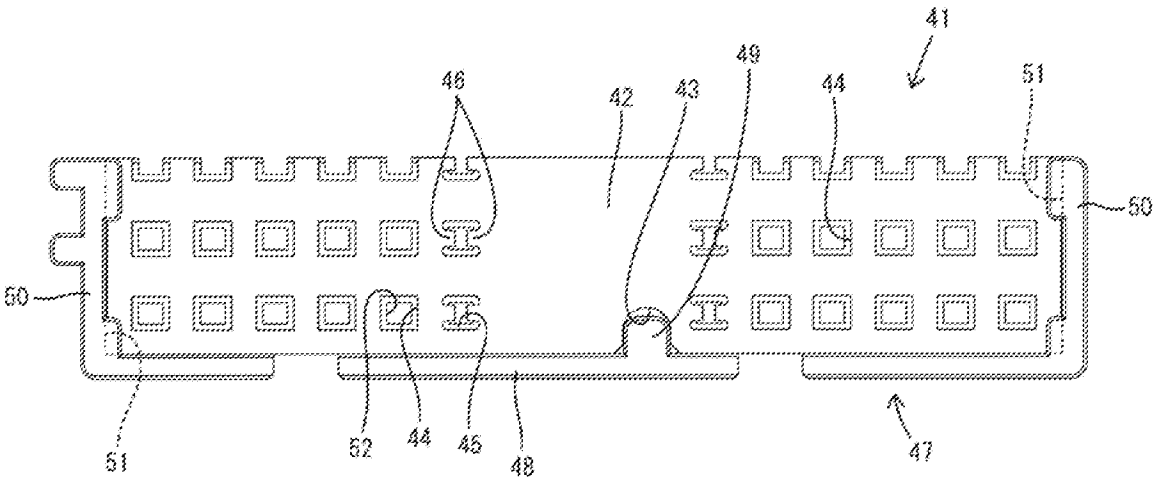
FIG. 12 is a front view of the short-circuit unit.
Figure 13:
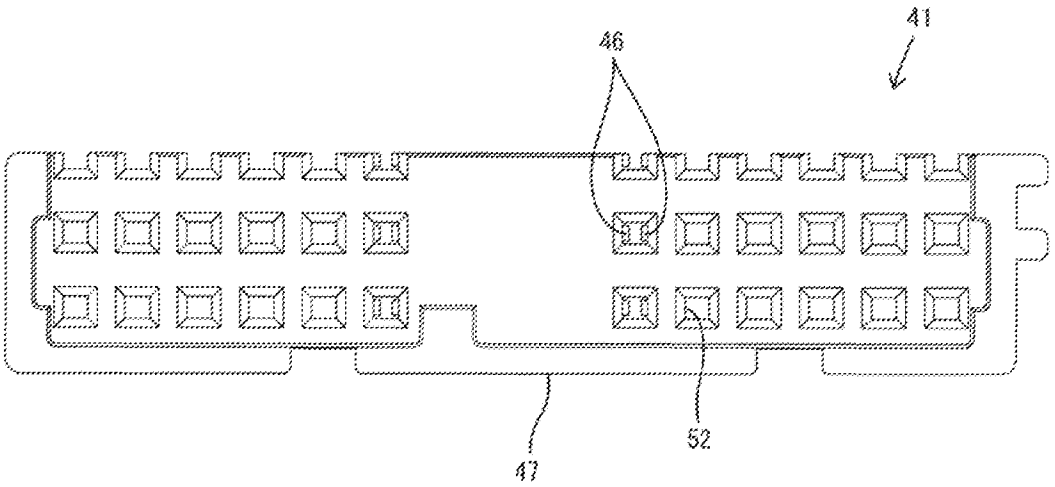
FIG. 13 is a back view of the short-circuit unit.
Figure 14:
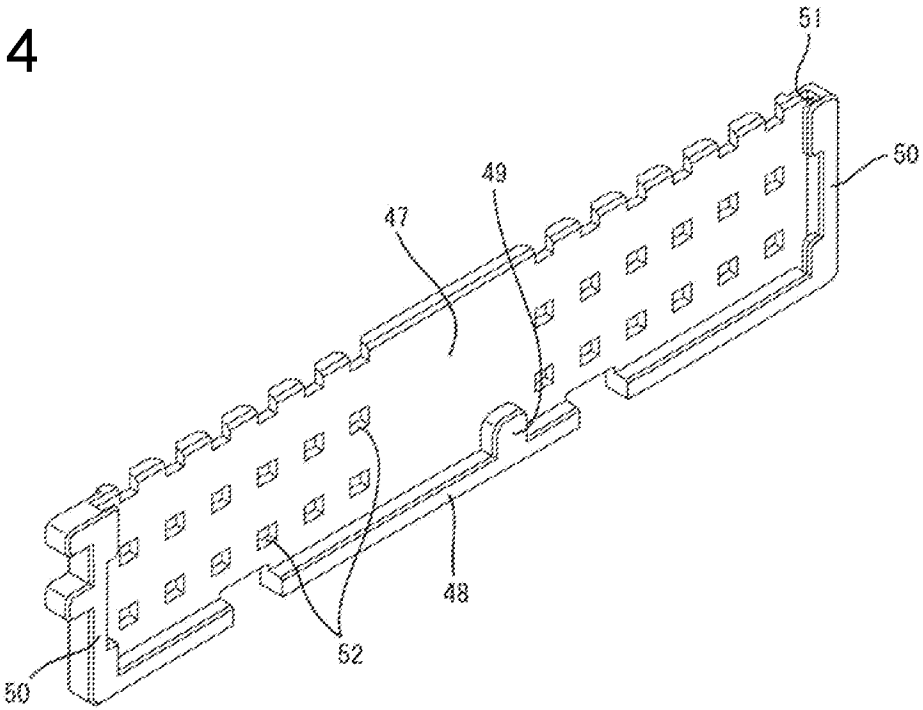
FIG. 14 is a perspective view of an insulating plate.

As shown in FIGS. 9 and 10, the short-circuit module 40 is configured by laminating short-circuit units 41. As shown in FIGS. 10 to 12, one short-circuit unit 41 is configured by assembling one short-circuit plate 42 (short-circuit member as claimed) made of metal and one insulating plate 47 (insulating member as claimed) made of synthetic resin.

The short-circuit plate 42 has a laterally long rectangular shape in a front view. An erroneous assembly preventing recess 43 (erroneous assembly preventing portion) is formed on one long side of the outer peripheral edge of the short-circuit plate 42. Non-contact holes 44 and conduction holes 45 are formed in the short-circuit plate 42 while being vertically and horizontally aligned to correspond to an arrangement of the tabs 37F, 37D, 37R. The non-contact holes 44 have a square opening shape. Respective sides of the non-contact holes 44 are dimensioned to be larger than heights and widths of the tabs 37F, 37D and 37R.

The conduction hole 45 has a lying H-shaped opening and includes two resilient contact pieces 46 projecting inward to face each other. The resilient contact pieces 46 are resiliently deformable, and a minimum interval between the resilient contact pieces 46 in a free state where the resilient contact pieces 46 are not resiliently deformed is smaller than the widths of the tabs 37F, 37D, 37R. Thus, the tabs 37F, 37D, 37R inserted through the conduction holes 45 are in a conductive state with the short-circuit plate 42. These conduction holes 45 and non-contact holes 44 are appropriately arranged according to a combination of the tabs 37F, 37D, 37R to be shorted.

The insulating plate 47 has a laterally long rectangular front view shape one size larger than the short-circuit plate 42. A receiving rib 48 projects forward on one long side (lower side in FIGS. 11, 12 and 14) of the outer peripheral edge of the insulating plate 47. An erroneous assembly preventing projection 49 (erroneous assembly preventing portion as claimed) projects from the receiving rib 48 and is to be fit to the erroneous assembly preventing recess 43 is formed on the front surface of the insulating plate 42.

Supporting ribs 50 projecting forward are formed on short sides of the outer peripheral edge of the insulating plate 47. The supporting ribs 50 are formed with mounting grooves 51 into which short sides of the outer peripheral edge of the short-circuit plate 42 are fit. Guide holes 52 penetrate the insulating plate 47 in a plate thickness direction while being vertically and horizontally aligned to correspond to the non-contact holes 44 and the conduction holes 45. The guide holes 52 have square openings. One side of the guide hole 52 is shorter than one side of the non-contact hole 44 and substantially equal to the height and width of the tab 37F, 37D, 37R.

Figure 15:
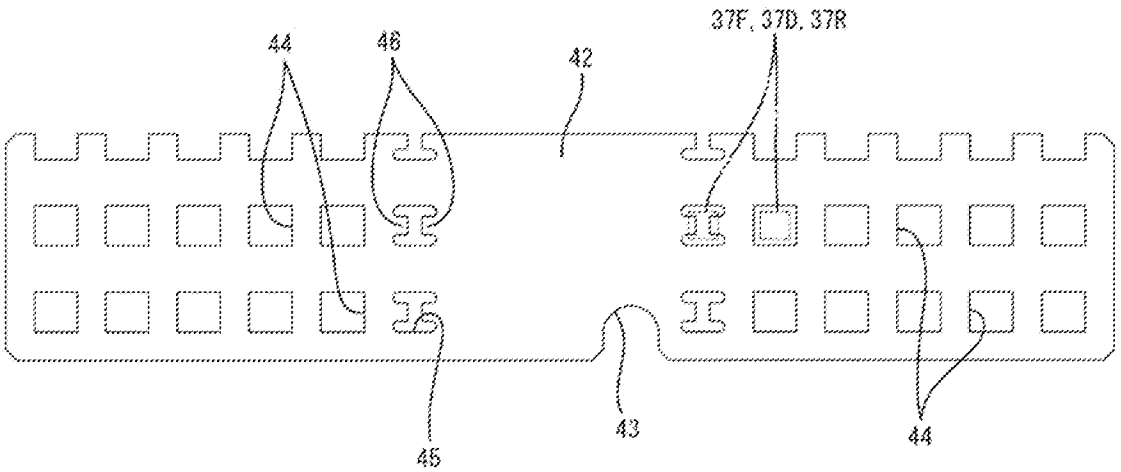
FIG. 15 is a front view of a short-circuit plate.
Figure 16:
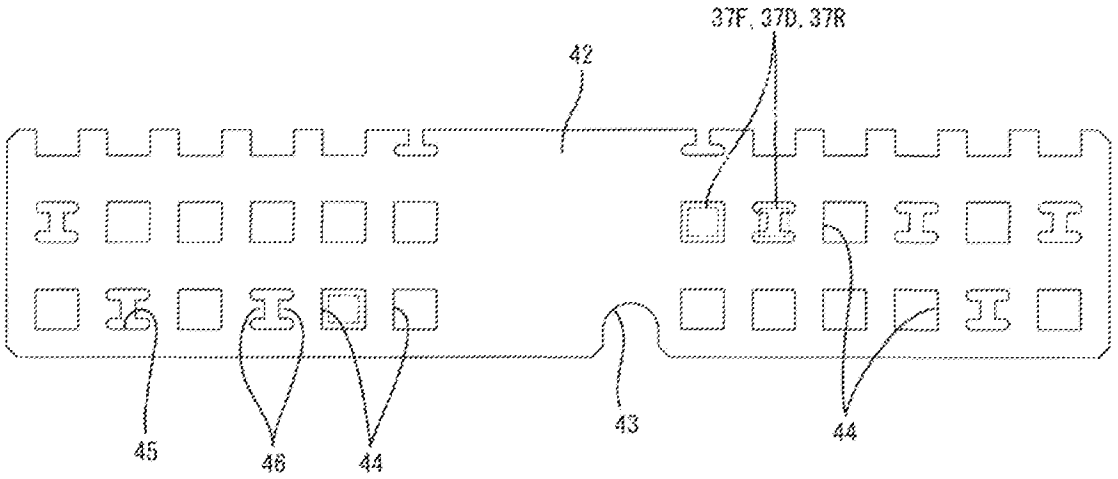
FIG. 16 is a front view of another short-circuit plate different from the short-circuit plate of FIG. 15.
Figure 17:
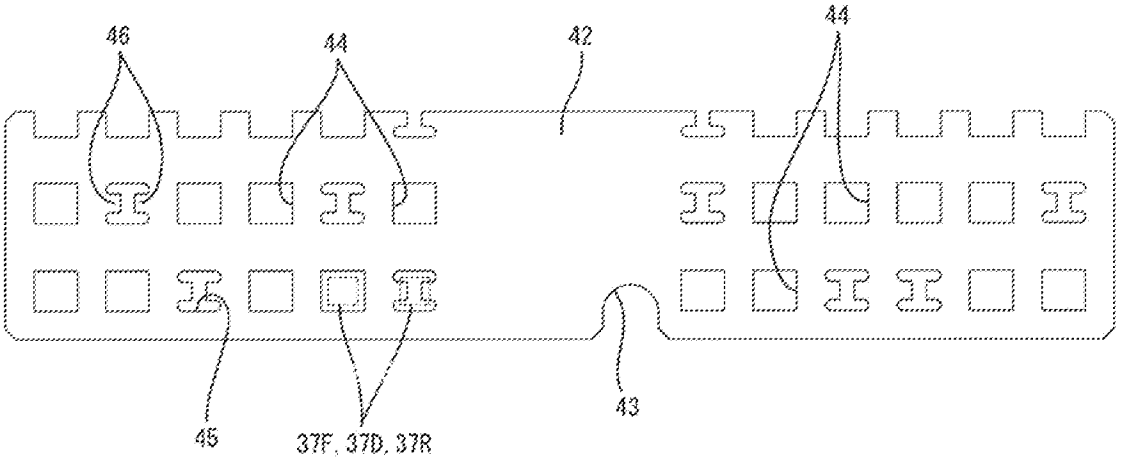
FIG. 17 is a front view of another short-circuit plate different from the short-circuit plates of FIGS. 15 and 16.

The insulating plate 47 used in each short-circuit unit 41 is a common component, but one of a plurality of different types of the short-circuit plates 42 is used for each short-circuit unit 41. As shown in FIGS. 15 to 17, each short-circuit unit 41 is different from the other short-circuit plates 42 in the arrangement and number of the conduction holes 45 and the arrangement and number of the non-contact holes 44. That is, one short-circuit module 40 is formed such different types of the short-circuit plates 42 are laminated via the insulating plates 47, in other words, such that a plurality of short-circuit plates 42 and a plurality of insulating plates 47 are alternately laminated.

<Internal Structure of Joint Connector A>

Inside the joint connector A, three short-circuit modules 40 are mounted in the body 11 while being individually accommodated in the accommodating portions 14 of the respective divided bodies 13 and held in contact with the separation walls 15. The front surface of the short-circuit plate 42 faces the separation wall 15 and the back surface of the insulating plate 47 faces toward the opening side of the accommodating portion 14. The terminal module 30 is also accommodated in the body 11.

The respective tabs 37F, 37D, 37R are inserted successively through the guide holes 52 and the non-contact holes 44 or the conductive holes 45 of the short-circuit module 40 and the positioning holes 16 of the separation wall portion 15. Extending end parts of the tabs 37F, 37D, 37R positioned by the positioning holes 16 are accommodated in each receptacle 12.

The forward facing tabs 37F passed through the conduction holes 45 of the respective short-circuit plates 42 are in a state capable of shorting to each other via the short-circuit plates 42. The forward facing tabs 37F passed through the non-contact holes 44 are not conductive with the short-circuit plates 42 formed with those non-contact holes 44. Since the forward facing tabs 37F are passed through the plurality of short-circuit plates 42 having different arrangements of the conduction holes 45, as many short-circuit patterns of the forward facing tabs 37F as the short-circuit plates 42 constituting one short-circuit module 40 can be set. The rearward facing tabs 37R can also be shorted to each other and the downward facing tabs 37D can also be shorted to each other in a plurality of patterns similarly to the forward facing tabs 37F.

Functions and Effects of Embodiment

The connector of this embodiment includes the housing 10, the plurality of terminal fittings 35, 35S, 35T provided in the housing 10 and each formed such that the plurality of tabs 37F, 37D, 37R are coupled by the terminal base portion 36, and the short-circuit modules 40. The short-circuit module 40 is provided in the housing 10 and formed such that the plurality of short-circuit plates 42 are arranged side by side in a length direction of the tabs 37F, 37D, 37R. The short-circuit plate 42 is formed with the conductive holes 45 for allowing the tabs 37F, 37D, 37R to pass therethrough in a contact state and the plurality of non-contact holes 44 for allowing the tabs 37F, 37D, 37R to pass therethrough in a non-contact state, and the arrangement of the conductive holes 45 differs among the short-circuit plates 42.

Since the respective tabs 37F, 37D, 37R pass through the short-circuit plates 42 and contact the short-circuit plates 42 in the conductive holes 45, the tabs 37F, 37D, 37R can be conductive with each other via one short-circuit plate 42. If the mating terminals 63 are connected to the plurality of tabs 37F, 37D, 37R, the mating terminals 63 connected to the tabs 37F, 37D, 37R in a conductive state can be shorted to each other. Since the short-circuit plates 42 for making the tabs 37F, 37D, 37R conductive with each other are arranged side by side in the length direction of the tabs 37F, 37D, 37R, the short-circuit plates 42 do not interfere with each other. Thus, the shapes of the short-circuit plates 42 can be simplified.

Further, the short-circuit plate 42 is in the form of a thin plate, and the conductive hole 45 is formed with the resilient contact pieces 46 projecting inward from a hole edge part of the conductive hole 45 and capable of resiliently contacting the tab 37F, 37D, 37R. When the tab 37F, 37D, 37R passes through the conductive hole 45, the plate-like resilient contact pieces 46 contact the tab 37F, 37D, 37R while being resiliently deformed to be curved. Thus, resistance when the tab 37F, 37D, 37R is inserted is reduced.

Further, since the short-circuit plates 42 are laminated via the insulating plates 47, a short circuit between the short-circuit plates 42 can be prevented. In this way, an inadvertent short circuit between the tabs 37F, 37D, 37R can be avoided. Furthermore, since the insulating plate 47 is formed with the guide holes 52 corresponding to the non-contact holes 44 and having a smaller opening region than the non-contact holes 44, the contact of the tabs 37F, 37D, 37R with the hole edge parts of the non-contact holes 44 is prevented. In this way, an inadvertent short circuit between the tabs 37F, 37D, 37R can be avoided.

Further, the insulating plates 47 and the short-circuit plates 42 can be assembled and one short-circuit unit 41 is configured by assembling the short-circuit plate 42 and the insulating plate 47. In this way, the short-circuit plates 42 and the insulating plates 47 are easily handled. Furthermore, since the short-circuit plate 42 and the insulating plate 47 are formed with the erroneous assembly preventing projection 49 and the erroneous assembly preventing recess 43 fittable only when the short-circuit plate 42 and the insulating plate 47 are properly assembled, it can be prevented that the short-circuit plate 42 and the insulating plate 47 are improperly assembled.

Other Embodiments

The invention is not limited to the above described embodiment. For example, the following embodiments also are included in the scope of the invention.

Although the plurality of short-circuit plates (short-circuit members) are laminated via the insulating plates (insulating members) in the above embodiment, a plurality of short-circuit members may be arranged while being spaced apart.

Although the insulating plate (insulating member) is formed with the guide holes corresponding to the non-contact holes and having a smaller opening region than the non-contact holes in the above embodiment, the insulating plate may not include such guide holes.

Although one short-circuit unit is configured by assembling the short-circuit plate (short-circuit member) and the insulating plate (insulating member) in the above embodiment, it may not be possible to assemble the short-circuit plate and the insulating plate.

Although the short-circuit plate (short-circuit member) and the insulating plate (insulating member) are formed with the erroneous assembly preventing portions (erroneous assembly preventing recess and erroneous assembly preventing projection) in the above embodiment, the short-circuit plate and the insulating plate may not be formed with the erroneous assembly preventing portions.

Although one short-circuit plate (short-circuit member) is mounted on one insulating plate (insulating member) in the above embodiment, a plurality of short-circuit plates may be mounted on one insulating plate. In this case, one short-circuit plate may be mounted on each of the front and back surfaces of the insulating plate or a plurality of short-circuit plates may be mounted on the front surface of the insulating plate in a non-contact state.

Although the conduction holes have an H-shaped opening in the above embodiment, the openings of the conduction holes may be I-shaped (slit-like) or U-shaped.

Although the joint connector and the terminal fittings have both the function of relaying the wiring harnesses and the function of branching the wiring harnesses in the above embodiment, the present invention can also be applied to the case where a joint connector and terminal fittings have either or neither one of the relaying function and the branching function.

LIST OF REFERENCE SIGNS

A . . . joint connector
10 . . . housing
35F . . . first terminal fitting (terminal fitting)
35S . . . second terminal fitting (terminal fitting)
35T . . . third terminal fitting (terminal fitting)
36 . . . terminal base portion
37F . . . forward facing tab (tab)
37D . . . downward facing tab (tab)
37R . . . rearward facing tab (tab)
40 . . . short-circuit module
42 . . . short-circuit plate (short-circuit member)
43 . . . erroneous assembly preventing recess (erroneous assembly preventing portion)
44 . . . non-contact hole
45 . . . conduction hole
46 . . . resilient contact piece
47 . . . insulating plate (insulating member)
49 . . . erroneous assembly preventing projection (erroneous assembly preventing portion)
52 . . . guide hole

The invention claimed is:

1. A joint connector, comprising:
a housing;
terminal fittings provided in the housing and each formed such that tabs are coupled by a terminal base; and
a short-circuit module provided in the housing and formed by arranging short-circuit members side by side in a length direction of the tabs;
each of the short-circuit members being formed with holes for allowing the tabs to pass therethrough; and
insulating members separating the short-circuit members from one another without passing through the holes of the short-circuit members, the insulating members having guide holes aligned respectively with the holes in the short-circuit member, wherein
the holes in the short-circuit members include conduction holes for allowing the tabs to pass therethrough in a contact state with the respective short-circuit member and further include non-contact holes each of which is dimensioned for allowing the tab of one of the terminal fittings to pass therethrough in a non-contact state, an arrangement of the conduction holes being different among the short-circuit members.

2. The joint connector of claim 1, wherein:
each of the conduction holes is formed with a resilient contact piece projecting inward from an edge part of the conduction hole and is configured for resiliently contacting the tab.

3. The joint connector of claim 2, wherein the short-circuit members are laminated respectively with the insulating members.

4. The joint connector of claim 3, wherein the guide holes have smaller opening regions than the non-contact holes.

5. The joint connector of claim 4, wherein the insulating members and the short-circuit members are configured to be assembled.

6. The joint connector of claim 5, wherein the short-circuit members and the insulating members are formed with erroneous assembly preventing portions fittable only when the short-circuit members and the insulating members are assembled properly.

7. The joint connector claim 1, wherein the short-circuit members are laminated respectively with the insulating members.

8. The joint connector of claim 1, wherein each of the insulating members has opposite first and second ends, first and second supporting ribs projecting respectively from the opposite first and second ends of each of the insulating members, first and second mounting grooves formed respectively in opposed facing surfaces of the first and second supporting ribs of each of the insulating members, each of the short-circuit members having opposite first and second ends engaged respectively in the first and second mounting grooves of the respective insulating member.

9. The joint connector of claim 8, wherein each of the insulating members further has a side edge extending between the opposite first and second ends and a receiving rib projecting from the side edge of each of the insulating members, the receiving rib of each of the insulating members engaging a side edge of the short-circuit member that has the opposite first and second ends engaged respectively in the first and second mounting grooves.

10. A joint connector, comprising:
a housing;
terminal fittings provided in the housing and each formed such that tabs are coupled by a terminal base; and
a short-circuit module provided in the housing and formed by arranging short-circuit members side by side in a length direction of the tabs;
each of the short-circuit members being formed with holes for allowing the tabs to pass therethrough; and
insulating members laminated respectively with the short-circuit members so that the insulating members separate the short-circuit members from one another, the insulating members having guide holes aligned respectively with the holes in the short-circuit member, wherein
the holes in the short-circuit members include conduction holes for allowing the tabs to pass therethrough in a contact state with the respective short-circuit member and further include non-contact holes each of which is dimensioned for allowing the tab of one of the terminal fittings to pass therethrough in a non-contact state, the non-contact holes being dimensioned so that the guide holes have smaller opening regions than the non-contact holes, and
an arrangement of the conduction holes is different among the short-circuit members.

11. The joint connector of claim 10, wherein the insulating members and the short-circuit members are configured to be assembled.

12. The joint connector of claim 11, wherein the short-circuit members and the insulating members are formed with erroneous assembly preventing portions fittable only when the short-circuit members and the insulating members are assembled properly.

* * * * *